US006859628B2

(12) United States Patent
Kobashigawa

(10) Patent No.: US 6,859,628 B2
(45) Date of Patent: Feb. 22, 2005

(54) IMAGE PROCESSING SYSTEM AND METHOD THAT USES AN ENVIRONMENTAL PARAMETER VALUE

(75) Inventor: Kei Kobashigawa, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/382,881

(22) Filed: Mar. 7, 2003

(65) Prior Publication Data

US 2004/0175195 A1 Sep. 9, 2004

(51) Int. Cl.[7] ..... G03G 15/00
(52) U.S. Cl. ..... 399/44
(58) Field of Search ..... 399/38, 44, 53, 399/94, 97

(56) References Cited

U.S. PATENT DOCUMENTS 5,305,057 A * 4/1994 Hattori et al.
6,463,226 B2 * 10/2002 Kitajima et al. ..... 399/44

FOREIGN PATENT DOCUMENTS

| | | | | |
|---|---|---|---|---|
| JP | 01180567 A | * | 7/1989 | ..... G03G/15/01 |
| JP | 6-282166 A | | 10/1994 | |
| JP | 9-146360 A | | 6/1997 | |
| JP | 63177176 B2 | | 7/1998 | |

* cited by examiner

*Primary Examiner*—Arthur T. Grimley
*Assistant Examiner*—Ryan Gleitz
(74) *Attorney, Agent, or Firm*—Foley & Lardner LLP

(57) ABSTRACT

A CPU computes a saturation moisture content on the basis of a temperature and a relative humidity detected by environment detection means, and multiplies the saturation moisture content by a square of the relative humidity, thus obtaining an environment parameter value. The CPU sets a proper development contrast potential using the environment parameter value according to a correlative approximation expression with pre-calculated development contrast potentials.

9 Claims, 4 Drawing Sheets

| TEMPERATURE (℃) | 10 | 15 | 20 | 25 | 30 | 35 | 40 | 45 | 50 |
|---|---|---|---|---|---|---|---|---|---|
| SATURATION MOISTURE CONTENT ($\times 10^{-3}$kg/kgD.A.) | 7.625 | 10.641 | 14.686 | 20.068 | 27.183 | 36.547 | 48.842 | 64.984 | 86.243 |
| (REFERENCE : MOISTURE VAPOR PRESSURE [mmHg]) | 9.204 | 12.783 | 17.530 | 23.753 | 31.823 | 42.178 | 55.333 | 71.891 | 92.545 |

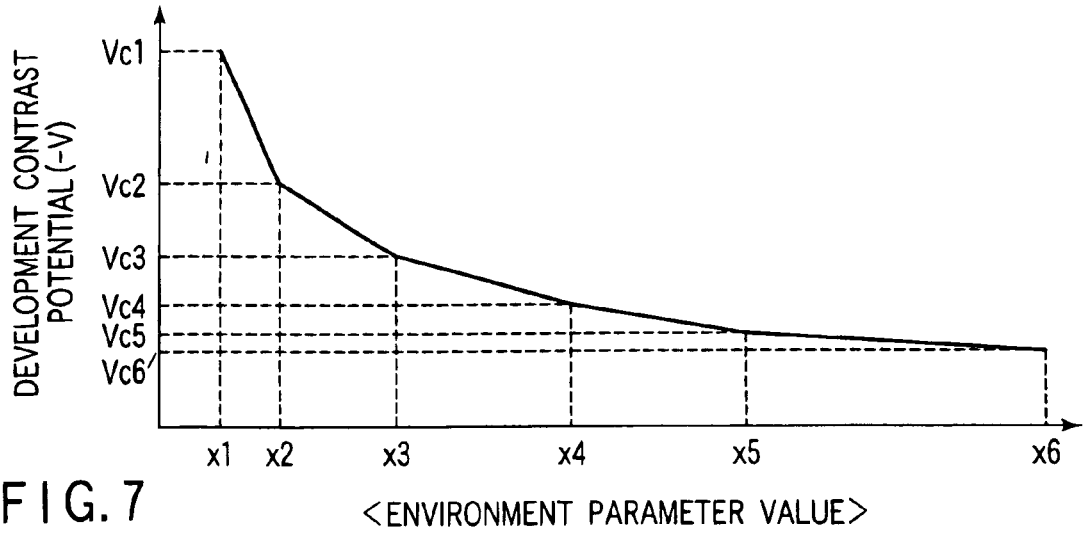
FIG. 7
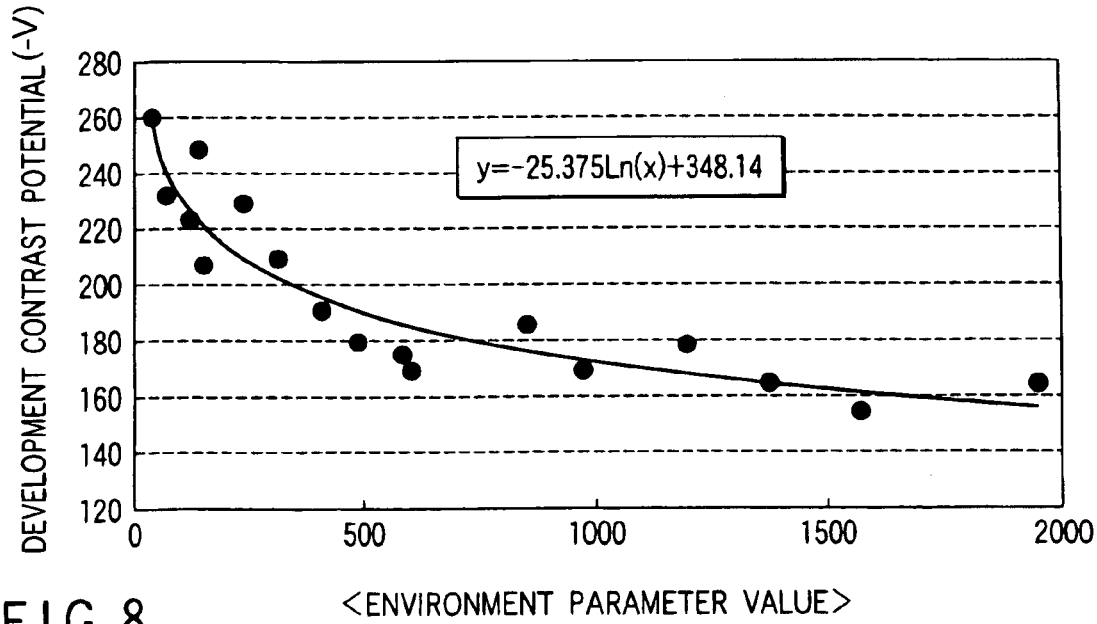
FIG. 8
| ENVIRONMENT PARAMETER VALUE | 71 | 156 | 345 | 755 | 1660 |
|---|---|---|---|---|---|
| DEVELOPMENT CONTRAST POTENTIAL(-V) GIVEN BY CORRELATIVE EXPRESSION | 240 | 220 | 200 | 180 | 160 |
| IMAGE DENSITY | 1.36 | 1.41 | 1.39 | 1.45 | 1.44 |
FIG. 9

IMAGE PROCESSING SYSTEM AND METHOD THAT USES AN ENVIRONMENTAL PARAMETER VALUE

BACKGROUND OF THE INVENTION

The present invention relates to an image forming apparatus and an image forming method for reading an image on an original and forming an image using electrophotography.

In a conventional image forming apparatus using electrophotography, the density of an image to be formed is maintained at a constant value by adjusting a charge potential of a photosensitive drum, a development bias potential applied to a developing device, etc., and controlling image formation conditions such as a development contrast potential and a background potential. In particular, in a color image forming apparatus, image formation conditions corresponding to characteristics of respective colors are set, and the density of each color is adjusted to become substantially equal.

In the method of the density adjustment, a toner image (density patch) of non-fixed toner is formed on a photosensitive drum or an intermediate transfer medium through a developing step, and the density of the density patch is measured by a sensor. In addition, environmental conditions within the apparatus are monitored by a system, and the density reproduction state is corrected and an error from a target density value is found. By multiplying the error by a feedback gain, a set-value correction amount within a control loop is computed to find a proper development contrast potential and background potential.

However, in the control for setting a charge potential, a development bias and an exposure amount by computing the proper development contrast potential and background potential, complex calculations are required in finding these values. In addition, in order to confirm whether an error from a target value is corrected for the density patch after density adjustment, it is necessary to form a density patch once again and measure the density patch. Then, if the error from the target value is not yet completely corrected, an error between the density patch and the target value is found and multiplied by a feedback gain. Thereby, a set-value correction amount is computed and a development contrast potential and a background potential within the control loop are found once again.

This process requires a relatively long time, although it depends on the method of forming the density patch. If environmental conditions within the apparatus vary within such a time period, the density reproduction state of the density patch would also vary and an error from the target value may not be corrected. This may lead to an excessively long processing time. A reason for this is that moisture absorption of a developer, which varies due to humidity in the apparatus, varies the density on the density patch, and this phenomenon is conspicuous. In particular, in a color image forming apparatus, density variations of density patches due to moisture absorption of respective color developers are non-uniform. As a result, a difference in density becomes conspicuous.

BRIEF SUMMARY OF THE INVENTION

The object of an aspect of the present invention is to provide an image forming apparatus and an image forming method, which can always form an image with an optimal density by adjusting a development contrast potential and a background potential at proper values relative to a variation in environment where a developer is present.

In order to achieve the object, the present invention may provide an image forming apparatus which includes image forming means for forming a latent image on a photoconductor using a developer of a single color or a plurality of colors, thus forming an image, the apparatus comprising: an environment detection section that detects an environment of the developer including a temperature and a relative humidity, the environment detection section being provided near a developing section that supplies the developer of the single color or the plurality of colors; a computing section that computes an environment parameter value on the basis of an environment condition detected by the environment detection section; a determination section that determines a development contrast potential for each of the colors of the developer, using the environment parameter value computed by the computing section; and a control section that controls the image forming means so as to obtain the development contrast potential determined by the determination section.

The present invention may also provide an image forming method with use of image forming means for forming a latent image on a photoconductor using a developer of a single color or a plurality of colors, thus forming an image, the method comprising: detecting a temperature near a developing section that supplies the developer of the single color or the plurality of colors; computing a saturation moisture content from the detected temperature; detecting a relative humidity near the developing section that supplies the developer of the single color or the plurality of colors; computing an environment parameter value from the detected relative humidity and the computed saturation moisture content; determining a development contrast potential on the basis of the computed environment parameter value; and controlling the image forming means so as to obtain the determined development contrast potential.

Additional objects and advantages of an aspect of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 7 shows a relationship between an environment parameter value and a development contrast potential in a case where a plurality of linear approximation expressions are combined;

FIG. 8 is a view for explaining a correlative expression; and

FIG. 9 shows environment parameter values and image density based on development contrast potential.

DETAILED DESCRIPTION OF THE INVENTION

An embodiment of the present invention will now be described with reference to the accompanying drawings.

Figure 1:
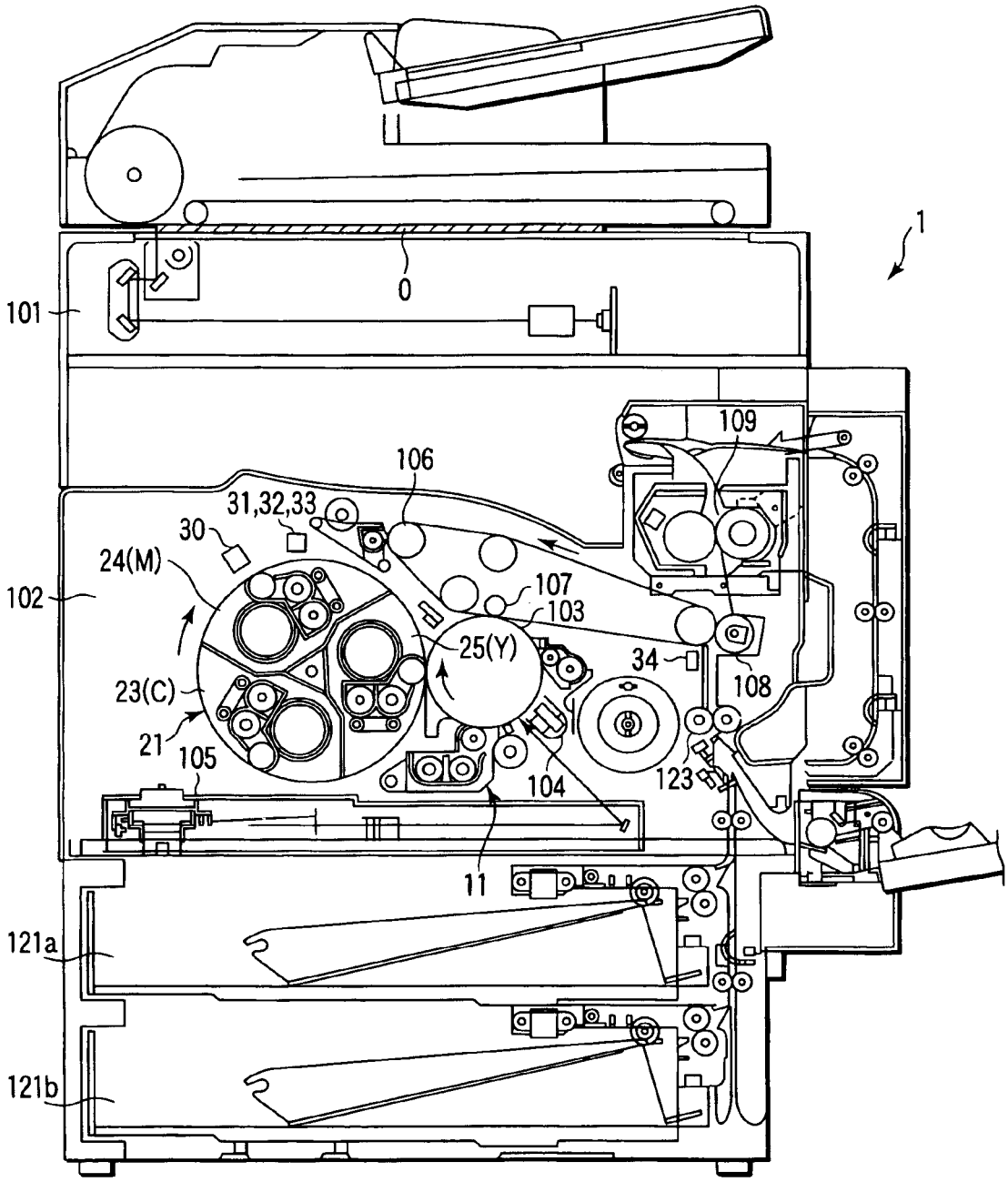
FIG. 1 is a cross-sectional view showing an internal structure of a color digital copying machine using electrophotography according to an image forming apparatus of an embodiment of the present invention.

FIG. 1 is a cross-sectional view showing an internal structure of a color digital copying machine 1 using electrophotography according to an image forming apparatus of an embodiment of the present invention. The color digital copying machine 1 comprises a scanner 101 that produces an image signal by reading image information on a to-be-copied object O as optical light/dark information, and a printer 102 that forms an image corresponding to an image signal supplied from the scanner 101 or from the outside.

Exposure light based on image data read by the scanner 101 and stored in an image memory (not shown) is radiated from an exposing device 105 onto a predetermined location on a photosensitive drum 103. Thereby, a latent image corresponding to the intensity of the exposure light is formed on the photosensitive drum 103.

The latent image formed on the photosensitive drum 103 is developed into a visible toner image by application of corresponding color toner supplied from a black (Bk) developing unit 11 for developing a black (Bk) single-color image, or from a color developing unit 21 for developing three single-color images of C(Cyan), M (Magenta) and Y (Yellow) that constitute a color image. The color developing unit 21 includes a C-developing device 23 for development with C (Cyan) toner, an M-developing device 24 for development with M (Magenta) toner, and a Y-developing device 25 for development with Y (Yellow) toner.

The photosensitive drum 103 is rotated and the toner image on the photosensitive drum 103 is moved to an intermediate transfer position where a transfer belt (intermediate transfer medium) 106 is opposed to the photosensitive drum 103.

The toner image on the photosensitive drum 103, which is moved to the intermediate transfer position, is transferred onto the transfer belt 106 by a roller 107.

The toner image transferred on the transfer belt 106 is moved to a transfer position where a transfer device 108 is opposed to the transfer belt 106 and the toner image is transferred onto an output medium. In addition, a paper sheet P is picked up from a cassette 121*a* or 121*b* at a predetermined timing and conveyed to an aligning roller 123. The sheet P is synchronized with the position of the toner image on the photosensitive drum 103 by means of the aligning roller 123, and is conveyed to the transfer position where the toner image is transferred on the sheet P. A predetermined transfer voltage is output from the transfer device 108. The sheet P may be replaced with, for instance, a colored sheet or a transparent resin sheet, in accordance with the user's demand.

The sheet P with the transferred toner image is conveyed to a fixing device 109 that produces a predetermined amount of heat. Thereby, the toner of the toner image is fused and fixed on the sheet P.

A toner concentration detector 30 is disposed near the color developing unit 21.

In addition, in the present invention, an environmental sensor serving as environment detection means, which comprises a temperature sensor 31, an atmospheric pressure sensor 32 and a relative humidity sensor 33, is provided near the color developing unit 21 (near a toner hopper (not shown)), that is, near a position where an environment (humidity, in particular) in which the toner is present is well reflected. Furthermore, a density detector 34 is provided.

Figure 2:
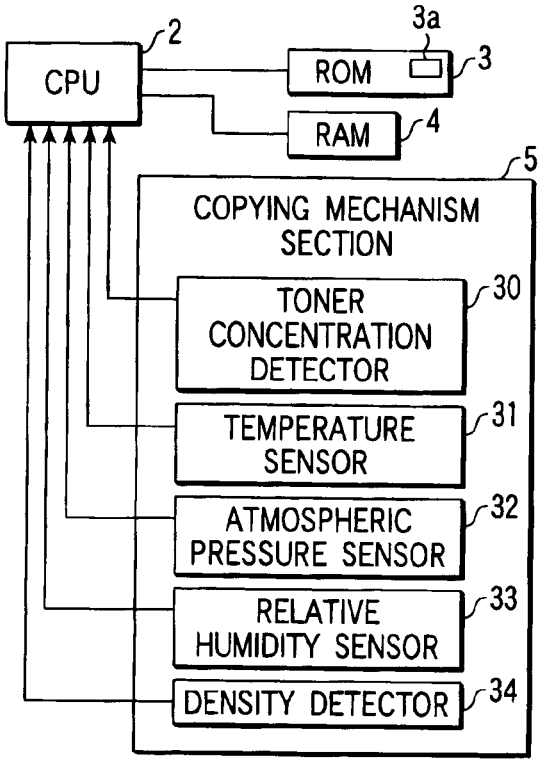
FIG. 2 is a block diagram showing a control system of the color digital copying machine.

FIG. 2 shows a control system of the color digital copying machine 1. Specifically, a CPU 2 controls the entirety of the color digital copying machine 1. The CPU 2 is connected to a ROM 3, a RAM 4 and a copying mechanism section 5 serving as image forming means. The ROM 3 stores, e.g. predetermined numerical data, and control data for operating the color digital copying machine 1. The RAM 4 temporarily stores, e.g. input copying condition data.

The copying mechanism section 5 is associated with the respective parts of the internal structure of the color digital copying machine 1 described with reference to FIG. 1. In the copying mechanism section 5, a grid voltage, from which a development contrast potential is obtained, is controlled by the CPU 2.

The CPU 2 receives detection outputs and sensor outputs from the toner concentration detector 30, temperature sensor 31, atmospheric pressure sensor 32, relative humidity sensor 33, and density detector 34.

The outline of the present invention will now be described.

Figure 3:
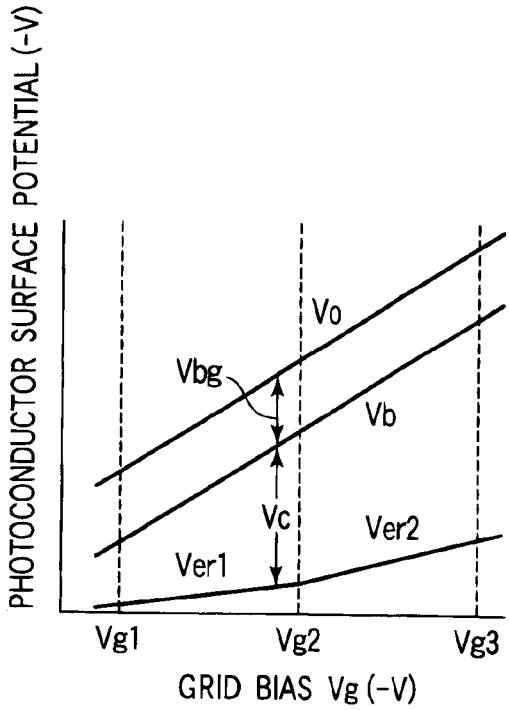
FIG. 3 shows a relationship between a grid bias voltage and a surface potential of a photosensitive drum.

FIG. 3 shows a relationship between a grid bias voltage (abscissa (Vg)) and a surface potential (ordinate) of photosensitive drum 103. Symbol Vo denotes a relationship between a non-exposed surface potential and a grid bias voltage Vg. Symbol Ver (1, 2) denotes a relationship between a surface potential of an exposed area and a grid bias voltage. Symbol Ver (1, 2) indicates a so-called residual potential.

Potential Vo is proportional to Vg. However, due to long-time use, the inclination and segment in the proportional expression will vary. Thus, the relationship between the grid bias and surface potential can be controlled more exactly by correcting the inclination and segment on an as-needed basis in accordance with the passing of the life of the photosensitive drum 103.

Similarly, Ver (1, 2) is basically proportional to Vg. However, compared to Vo, the inclination and segment are smaller than those of Vo. As Vg increases, the inclination of Ver increases and the segment decreases. It is thus effective to provide an approximation expression of two or more straight lines, as shown in FIG. 3.

Assuming charge curves such as Vo and Ver (1, 2) in FIG. 3, the CPU 2 effects a control to make a development contrast potential (to be described later), i.e. a difference between a development bias DC component and Ver (1, 2), equal to a computation result of the development contrast potential (to be described later) within the curves. In this case, a required development contrast potential can be obtained by finding the grid bias voltage Vg by computation.

Figure 4:
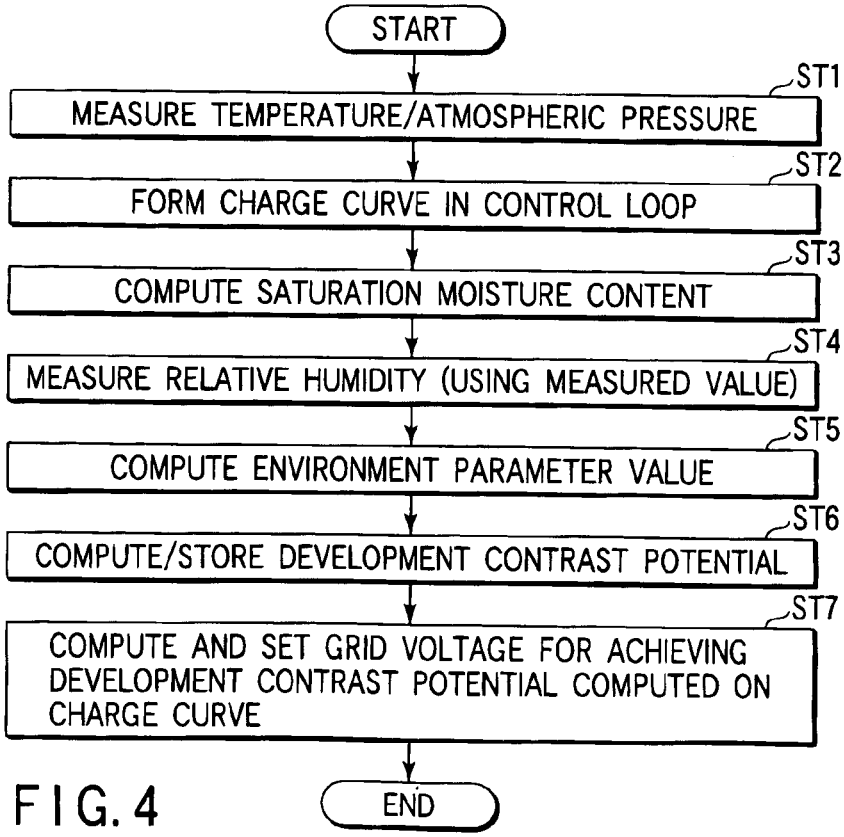
FIG. 4 is a flow chart illustrating a control operation for a development contrast potential.

A control operation for the development contrast potential in the above structure will now be described with reference to a flow chart of FIG. 4.

To start with, the CPU 2 measures the temperature and humidity using the temperature sensor 31 and atmospheric pressure sensor 32 (ST1).

The CPU 2 prepares a charge curve within the control loop described with reference to FIG. 3 (ST2).

The CPU 2 computes a maximum moisture content (saturation moisture content) that can be contained in a unit volume (ST3), on the basis of the temperature under the condition and the environmental information under the atmospheric pressure (ST3). Strictly speaking, the saturation moisture content varies depending on the atmospheric pressure. It is assumed, however, that the atmospheric pressure is 1 atm (1013.25 hPa) that is the standard atmospheric pressure.

The saturation moisture content is found from a table 3*a* provided in advance in the control loop for respective temperatures. The table 3*a* is pre-stored in the ROM 3.

Figures 5, 6:
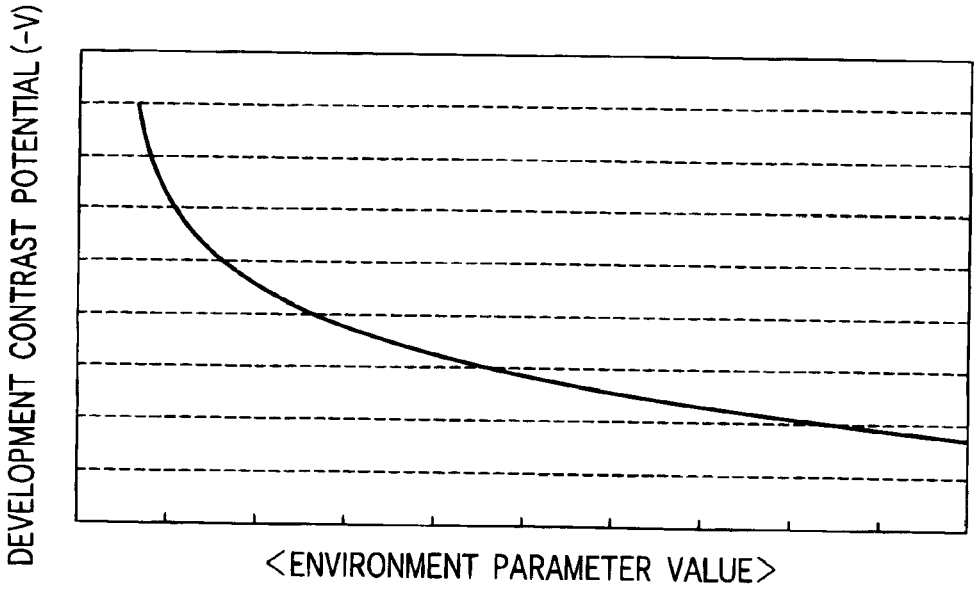
FIG. 5 shows an example of a table.
FIG. 6 shows a relationship between an environment parameter value and a development contrast potential.

FIG. 5 is an example of the table 3*a*.

If the measured temperature does not agree with temperatures indicated by integers in the table 3*a* (e.g. 27° C.), the values related to 25° C. and 30° C. are subjected to linear interpolation, thus finding the saturation moisture content. Needless to say, if the number of divisions of temperatures indicated in the table 3*a* is increased, a more exact value is obtained. The value of the saturation moisture content is used as such, with the unit of ($x10^{-3}$ kg/kg D.A.).

Then, the CPU 2 measures the relative humidity (% R.H.) using the relative humidity sensor 33 (ST4). The measured value of relative humidity is used as such, with the unit of (% R.H.). Various kinds of sensors usable in electrophotographic image forming apparatuses may be used for the relative humidity sensor 33.

Subsequently, the CPU 2 computes an environment parameter value using the following formula (ST5):

environment parameter value=(saturation moisture content found in step ST3)×(value of relative humidity measured in step ST4)$^2$.

FIG. 6 is a graph in which the environment parameter value found in step ST5 is plotted in the abscissa and a development contrast potential derived from the environment parameter value is plotted in the ordinate. A curve in FIG. 6 is obtained by a log-transformed correlative approximation expression. It is also possible, however, to set a development contrast potential by combining a plurality of linear approximation expressions. Specifically, as shown in FIG. 7, environment parameter values are divided into some blocks, and development contrast potentials at end points of linear approximation expressions are provided in the table 3*a*. Linear interpolation is performed between two straight lines, and thus development contrast potentials associated with the environment parameter values are derived and set.

The log-transformed correlative approximation expression or the approximation expression obtained by combining linear approximation expressions, which is prepared in step ST5, is obtained by experiments for respective kinds of developers. Accordingly, in a single-color electrophotographic image forming apparatus, it should suffice to prepare one approximation expression for development contrast potential computation. However, in a multi-color electrophotographic image forming apparatus, it is necessary to prepare approximation expressions for respective colors in the control loop.

In step ST3, it is assumed that the atmospheric pressure is 1 atm (1013.25 hPa), but various tables for different atmospheric pressures may be prepared. When such various tables are prepared, the calculation table is switched on a case-by-case basis and thereby a more exact maximum moisture content can be calculated. Accordingly, the development contrast potential, which is finally found in step ST5, can take a more exact value.

The CPU 2 computes the development contrast potential and stores it in the RAM 4 (ST6).

The CPU 2 then computes and sets a grid voltage, with which the development contrast potential computed on the charge curve is obtained (ST7).

A method of confirming the feasibility (effectiveness) of the approximation expressions shown in FIGS. 6 and 7 will now be explained. The following is an experimental example.

A developer mentioned below was used in finding approximation expressions for development contrast potential computation in the present invention.

A developer is a two-component type developer in which toner containing polyester resin and ferrite-based magnetic carrier are stirred and mixed. The toner is provided with charge by frictional electrification. The toner is attached to the electrostatic latent image on the photosensitive drum 103 that is the image carrying body. The amount of attached toner is determined by electrification characteristics of the toner in the environment and a development contrast potential of the image forming apparatus. If the toner and the carrier of the same material are mixed under the same condition and left for a predetermined time period in the same environment, the electrification characteristics of the toner of each developer are always constant at the initial time. It was thus assumed that the image density corresponding to the charge amount was variable due to a development contrast potential.

To begin with, optimal attenuation characteristics of the photosensitive drum 103 were found. Three environments with 10° C., 25° C. and 50° C. were prepared. The grid bias was set at −300V, −600V and −900V. The surface of the photosensitive drum 103 was charged and the surface potential Vo was measured.

A laser beam was used for exposure. The laser power was voluntarily varied between 0 and 600 $\mu$W to control the exposure amount. Thus, the residual potential Ver was measured.

Based on the above, a relationship between the grid bias voltage and surface potential, as shown in FIG. 3, was found.

An expression of development bias potential Vb was provided, with background potential Vbg set at a constant value. Since the inclination of residual potential Ver is gentler than that of surface potential Vo, the development contrast potential Vc gradually increases by increasing the grid bias potential Vg. Therefore, by varying the grid bias Vg, the development contrast potential was successfully adjusted at a desired value.

Then, a $\gamma$ curve of the developer was measured. The $\gamma$ curve indicates characteristics of the developer, with the image density varied by altering the contrast potential. Thereby, a required development contrast potential can be obtained when a desired image density is set at "1.4", and the obtained value is recorded.

Further, the developer is left in each environment, and the $\gamma$ curve is similarly measured. The charge characteristics of the toner vary due to the environment, and accordingly the image density varies. Assuming that the desired image density is "1.4", a required development contrast potential is derived from the $\gamma$ curve and the derived potential value is recorded. At the same time, the temperature and relatively humidity are measured in the measurement environment, and recorded for computation of environment parameters. The atmospheric pressure in the experiment bath is maintained at a constant value (1 atm).

The environment parameter is obtained by the following formula:

environment parameter value=(saturation moisture content relative to temperature in each experiment)×(value of relative humidity)$^2$.

Based on the above result, a graph of FIG. 8 was obtained. In FIG. 8, the calculated environment parameter is plotted on the abscissa, and the development contrast potential Vc necessary for achieving the image density, 1.4, is plotted on the ordinate. The plot points in FIG. 8 are log-approximated to find a correlative expression.

With the correlative expression found, the development contrast potential required in each environment was successfully calculated. In order to confirm the effectiveness of the correlative expression, confirmation was made to determine what image density was obtained with development contrast potentials computed at temperatures and relative humidities different from those in the environments, except for the atmospheric pressure, already used in the above-described experiments.

FIG. 9 shows the result of confirmation.

The image density of ±0.5 relative to the target image density of "1.4" as mentioned above was obtained. Thus, a conclusion is reached that the correlation between the environment parameter and development contrast potential value is effective.

The above-described experiment was conducted for each of the colors used in the color digital copying machine 1. In this case, the γ curve varied from color to color, and also the development contrast potential for achieving the image density of 1.4 varied. However, it was common that the environment parameter value and development contrast potential value are log-approximated. The image density, which is obtained by the setting of the development contrast potential required when the environment is varied based on the correlative expression, was always within the range of 1.4±0.5.

Therefore, a conclusion is reached that the development contrast potential calculated based on the environment parameter is also effective for the color developing device and is applicable to various types of electrophotographic image forming apparatuses.

In addition, in the above experiments, the two-component developer system was used. The invention is similarly applicable to a non-magnetic single-component developer system in which the image density varies depending on the charge of toner.

In the above embodiment, the development contrast potential is determined by the grid bias voltage. Alternatively, the development contrast potential may be determined by varying other conditions, such as charge potential of developer, if the development contrast potential with a desired value is obtained.

As has been described above, according to the embodiment of the present invention, a proper development contrast potential is set in the image forming apparatus in accordance with a correlative approximation expression with pre-calculated development contrast potentials, whereby a proper image density can be obtained regardless of a variation in environment.

This can omit the prior-art process wherein a toner image (density patch) of non-fixed toner is formed on a photoconductor or an intermediate transfer medium, the density of the density patch is measured by a sensor, environmental conditions within the apparatus are monitored by a system, and the density reproduction state is corrected and an error from a target density value is found, following which the error is multiplied by a feedback gain to correct a set value within a control loop. Therefore, a time necessary for complex controls and calculations and for formation of the density patch becomes needless, and the control loop is simplified and reduced in time.

Furthermore, the control loop of this invention may be used along with the prior-art feedback loop, whereby the image density can be controlled with higher precision.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus which includes image forming means for forming a latent image on a photoconductor using a developer of a single color or a plurality of colors, thus forming an image, the apparatus comprising:

a temperature detection section that detects a temperature, the temperature detection section being provided near a developing section that supplies the developer of the single color or the plurality of colors;

a processor that computes a saturation moisture content from the temperature detected by the temperature detection section;

a relative humidity detection section that detects a relative humidity, the relative humidity detection section being provided near the developing section that supplies the developer of the single color or the plurality of colors;

the processor computes an environment parameter value from the relative humidity detected by the relative humidity detection section and the saturation moisture content computed by the processor;

the processor determines a development contrast potential for each of the colors of the developer, on the basis of the environment parameter value computed by the processor; and the processor controls the image forming means so as to obtain the development contrast potential determined by the processor.

2. The image forming apparatus according to claim 1, wherein the processor computes the saturation moisture content on the basis of information on a saturation moisture content associated with each of preset temperatures.

3. The image forming apparatus according to claim 1, wherein the processor computes the environment parameter value using an expression: (saturation moisture content)× (value of relative humidity)$^2$.

4. The image forming apparatus according to claim 1, wherein the processor determines the development contrast potential on the basis of information on a proper development contrast potential associated with each of preset environment parameter values.

5. The image forming apparatus according to claim 1, wherein the processor effects a control to compute and set a grid bias voltage in the image forming means so as to obtain the determined development contrast potential.

6. The image forming apparatus according to claim 1, wherein the processor effects a control to set a charge potential of the developer so as to obtain the determined development contrast potential.

7. The image forming apparatus according to claim 1, wherein the processor alters a condition for controlling the image forming means so as to obtain the determined development contrast potential.

8. An image forming method with use of image forming means for forming a latent image on a photoconductor using a developer of a single color or a plurality of colors, thus forming an image, the method comprising:

detecting a temperature near a developing section that supplies the developer of the single color or the plurality of colors;

computing a saturation moisture content from the detected temperature;

detecting a relative humidity near the developing section that supplies the developer of the single color or the plurality of colors;

computing an environment parameter value from the detected relative humidity and the computed saturation moisture content;

determining a development contrast potential on the basis of the computed environment parameter value, and controlling the image forming means so as to obtain the determined development contrast potential.

9. An image forming apparatus which includes image forming unit for forming a latent image on a photoconductor using a developer of a single color or a plurality of colors, thus forming an image, the apparatus comprising:

a temperature detection section that detects a temperature, the temperature detection section being provided near a developing section that supplies the developer of the single color or the plurality of colors;

a processor that computes a saturation moisture content from the temperature detected by the temperature detection section;

a relative humidity detection section that detects a relative humidity, the relative humidity detection section being provided near the developing section that supplies the developer of the single color or the plurality of colors;

the processor computes an environment parameter value from the relative humidity detected by the relative humidity detection section and the saturation moisture content computed by the processor;

the processor determines a development contrast potential for each of the colors of the developer, on the basis of the environment parameter value computed by the processor; and the processor controls the image forming unit so as to obtain the development contrast potential determined by the processor.

* * * * *